US006073400A

United States Patent [19]

Balisle et al.

[11] Patent Number: 6,073,400

[45] Date of Patent: Jun. 13, 2000

[54] ROOF DRIP EDGE CONSTRUCTION, CORNER ASSEMBLIES THEREFOR AND METHODS OF MAKING SAME

[76] Inventors: Tony R. Balisle, 2818 W. Grayrock, Springfield, Mo. 65810; Calvin M. Budd, 1244 Mills Rd., Ozark, Mo. 65721

[21] Appl. No.: 09/181,503

[22] Filed: Oct. 28, 1998

[51] Int. Cl.[7] ..... E04D 13/15

[52] U.S. Cl. ..... 52/58; 52/94; 52/96; 52/302.6

[58] Field of Search ..... 52/58, 60, 61, 52/62, 94, 96, 97, 302.6, 655.1, 656.1, 657, 658

[56] References Cited

U.S. PATENT DOCUMENTS

| | | | |
|---|---|---|---|
| 443,322 | 12/1890 | Kinnear | 52/94 |
| 1,299,421 | 4/1919 | Boss | 52/96 |
| 1,480,246 | 1/1924 | Douglas | 52/94 |
| 2,255,279 | 9/1941 | Callaway | 52/61 |
| 2,723,731 | 11/1955 | Schaaf | 52/658 |
| 2,857,861 | 10/1958 | Trostle | 52/94 |
| 3,012,376 | 12/1961 | Reddy et al. | 52/97 X |
| 3,093,931 | 6/1963 | Waring | 52/96 |
| 3,181,275 | 5/1965 | Schroter et al. . | |
| 3,199,256 | 8/1965 | Considder | 52/60 X |
| 4,489,532 | 12/1984 | Ellis et al. . | |
| 4,741,132 | 5/1988 | Emblin . | |
| 4,890,426 | 1/1990 | Hickman et al. . | |
| 4,969,250 | 11/1990 | Hickman et al. . | |
| 5,189,853 | 3/1993 | Braine et al. | 52/96 |
| 5,251,411 | 10/1993 | Kelley et al. | 52/60 |
| 5,515,653 | 5/1996 | Smart | 52/60 |
| 5,577,354 | 11/1996 | Van Doren | 52/94 |
| 5,706,611 | 1/1998 | Attaway et al. | 52/97 X |
| 5,718,094 | 2/1998 | Mauer | 52/656.8 |
| 5,884,435 | 3/1999 | David et al. | 52/58 X |

*Primary Examiner*—Laura A. Callo
*Attorney, Agent, or Firm*—Richard L. Marsh

[57] ABSTRACT

An improvement in a pitched hip roof construction of a building construction is provided wherein the building construction has at least four wall sections, the roof construction comprising roof decking portions joined at at least the exterior hip junctures thereof, the outer edge of the roof construction overhanging the walls of the building construction and terminating in a roof edge plate affixed to the ends of roof rafters which are adapted to support the decking portions and the subsequent exterior roofing materials. The improvement in the roof construction further comprises having a roof drip edge applied over the terminal end of the decking portions and the roof edge plate, wherein the end of each juncture has means for covering affixed thereto prior to applying the exterior roofing materials.

20 Claims, 6 Drawing Sheets

ROOF DRIP EDGE CONSTRUCTION, CORNER ASSEMBLIES THEREFOR AND METHODS OF MAKING SAME

BACKGROUND OF THE INVENTION

1. Field of the Invention

This invention relates to roof drip edge assembly for a pitched roof and particularly for fabricated corner assemblies for valley corners or hip corners.

2. Prior Art Statement

It is known to provide a soffit construction which snaps into place under the eave of a roof having the outer edge jaw structure depending from the roof edge plate and attached thereto behind a conventional drip edge. For instance, see the U.S. Pat. No. 3,181,275 issued on May 4, 1965, to Schroter, et al.

It is also known to provide a metallic roof structure, one piece thereof comprising a drip edge with an interlocking channel for receiving the first shingle therein and further comprising a metallic valley base having the edges of shingles from adjoining roof portions bent into a channel in the valley base with a sealant placed into the junction of the adjoining shingles. For instance, see the U.S. Pat. No. 4,489,532 issued on Dec. 25, 1984 to Ellis, et al.

It is further known to provide elbow flashing sections at the corners of the building parapet for a built-up roof structure. For instance, see U.S. Pat. No. 4,741,132 issued on May 3, 1988 to Robert T. Emblin.

Additionally, it is known to provide corner elements for the corners of the building parapet for a built-up roof structure made of three pieces joined together by interlocking discontinuities along cooperating flanges and further including overlapping angled corners for a raised roof. In order to avoid leaving an unsightly opening or gap in the lower lip or drip edge mentioned above, the inventors provide an insert member adapted to be inserted into the opening in order to substantially fill the opening upon completion of the fabrication operations. For instance, see U.S. Pat. No. 4,890,426 issued on Jan. 2, 1990 and U.S. Pat. No. 4,969,250 issued on Nov. 13, 1990 both to Hickman, et al.

SUMMARY OF THE INVENTION

Although a drip edge is provided in the prior art, no means of joining drip edge portions at an exterior juncture or an interior juncture of the roof decking, commonly referred to as hip corners and valley corners, respectively, is provided. Conventional practice is to nip off the ends of the drip edge with metal shears near the corner of the roof as the drip edge will be obscured by the guttering. As such, in the interest of saving time, the construction worker takes little care in nipping off the drip edge and thus the hip corner may have a gap of up to two inches between the ends of adjoining drip edge portions. Similarly, a valley corner may have the ends of the drip edge cut substantially square with the drip edge flange abutted in the corner but with a wedge shaped discontinuity at the valley base. In either case, although these gaps or discontinuities are typically filled with roofing cement or a plasticized mastic, water may still flow off the edge of the roof and travel behind the drip edge at these discontinuities causing alternating wetting and drying of the roof edge plate, the rafters and the roof decking thereby ultimately resulting in dry rot of these timbers. Furthermore, with different pitches of the roof of various building constructions, cutting of the drip edge to make a precise mitered corner for each pitch is different, therefore building construction workers do not attempt to make a valley or hip corner when applying drip edge to the roof edge even though the same drip edge may be utilized on these building constructions having different pitches as the roof flange may flex relative to the drip flange as the shingle extension is a folded over portion of the roof flange folded back upon itself to the location of the drip flange.

Hence, a great need exists for pre-made fabricated corner assemblies for the drip edge of a pitched roof in a building construction that can be quickly placed in position, affixed to the roof decking or roof edge plate and thereafter overlapped at both ends with elongated straight sections of drip edge extending away therefrom along the roof edge plate. A further need exists for pre-made fabricated corner assemblies which may be utilized on various roof pitches. Yet another need is to manufacture fabricated corner assemblies from existing drip edge with a minimum of waste material.

Therefore it is an object of this invention to provide fabricated corner assemblies for the drip edge of a pitched roof in a building construction, each fabricated corner assembly comprising one elongated portion of drip edge miter cut on at least one end thereof and one elongated portion of drip edge straight cut on at least one end thereof one end of the straight cut portion adapted to bent to underlie one end of the miter cut portion of the drip edge and be fixedly retained thereto to form the fabricated corner assembly.

It is yet another object of this invention to provide fabricated corner assemblies for a valley corner of a pitched roof construction.

It is yet another object of this invention to provide fabricated corner assemblies for a hip corner of a pitched roof construction.

It is another object of this invention to provide fabricated corner assemblies for the drip edge of the differing pitched roofs of various building constructions.

Yet another object of this invention is to provide a fabricated corner assembly having the bent end of the roof engaging portion of the one end of the straight cut portion underlying the miter cut roof engaging flange portion of the one end of the miter cut portion.

Still another object of this invention is to provide a fabricated corner assembly having the bent end of the drip flange portion of the one end of the straight cut portion underlying the miter cut drip flange portion of the one end of the miter cut portion.

DESCRIPTION OF THE PREFERRED EMBODIMENTS

While the various features of this invention are hereinafter described and illustrated as fabricated corner assemblies for the drip edge of a pitched roof in a building construction, wherein each fabricated corner assembly comprises one elongated portion of drip edge miter cut on at least one end thereof and one elongated portion of drip edge straight cut on at least one end thereof and wherein one end of the straight cut portion is bent to underlie the miter cut portion of the drip edge and be fixedly retained thereto to form the fabricated corner assembly, it is to be understood that the various features of this invention can be used singly or in various combinations thereof to provide other fabricated corner assemblies for the drip edge of a pitched roof in a building construction as can hereinafter be appreciated from a reading of the following description.

Figure 1:
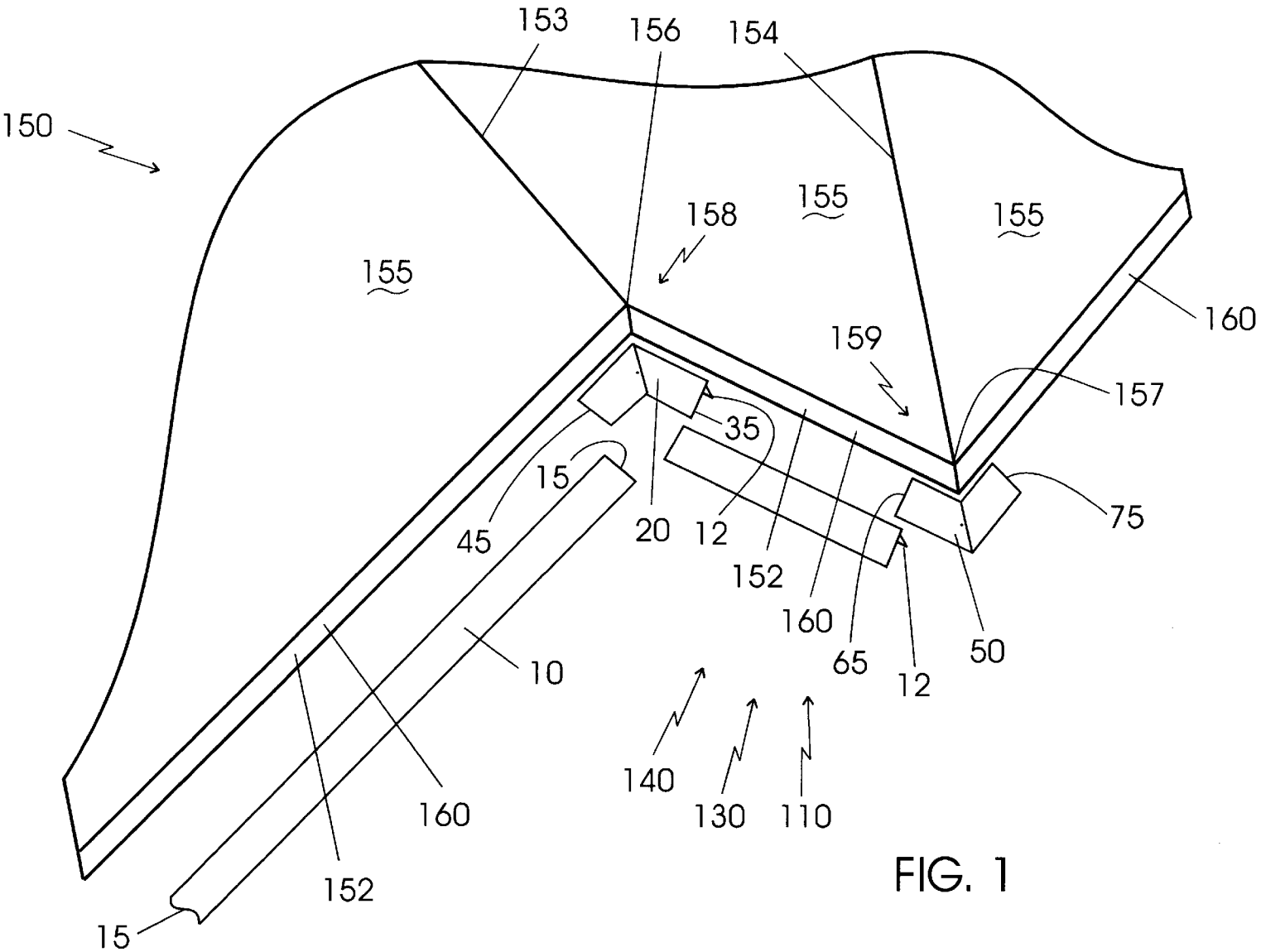
FIG. 1 is a partial perspective view of a roofing construction showing the preferred embodiment of the corner assemblies of this invention ready to be installed thereon.

Referring to FIG. 1, a pitched hip roof construction 150 of a building construction having at least four wall sections typically comprises roof decking portions 155 joined at exterior hip junctures 154. The pitched hip roof construction 150 of FIG. 1 further has at least one valley juncture 153 adjacent two of roof decking portions 155 and thus the pitched hip roof construction 150 of FIG. 1 comprises roof decking portions 155 joined at at least one interior valley juncture 153 and at at least one exterior hip juncture 154. The outer edge 160 of roof construction 150 overhangs the walls of the building construction and has a roof edge plate 152 affixed to the ends of the rafters (not shown) which support the decking portions 155 and the subsequent roofing exterior materials (not shown). Prior to applying the subsequent roofing exterior materials, ie., roofing paper and the final shingling, roof construction 150 further has a roof drip edge 10 formed from elongated straight sections 111 of thin material having a T-shaped cross section, shown adjacent two portions of roof edge plates 152, applied over the terminal end of the decking portions 155 and the roof edge plate 152. As hereinbefore mentioned, and as can be readily appreciated by those skilled in pitched roof constructions, the ends 15 of roof drip edge 10 are usually nipped off with hand held metal shears in such a fashion that ends 15 generally do not meet or overlap along the cut ends 15 thereof at either the end 156 of valley juncture 153 or the end 157 of hip juncture 154 and therefore a gap exists between the ends 15 of adjoining sections of drip edge 10. This does not occur along the elongated sections of roof edge plate 152 as the straight sections 111 of drip edge 10 are overlapped at the ends 15 thereof. Therefore, there is no problem with flow of fluids such as water seepage into the roof construction 150 along elongated sections of roof edge plate 152, however, at ends 156, 157 the gap between ends 15 of drip edge 10 often causes flow of fluids such as runoff from the roof to seep under drip edge 10 and be absorbed by the wooden portions of the roof construction 150.

In this invention, referring to FIG. 1, a pitched roof construction 150 comprising roof decking portions 155, rafters (not shown) supporting the roof decking portions 155, roof edge plates 152 affixed to mitered ends (not shown) of the rafters adjacent the open outer edge 160 of the roof construction 150, a roof covering (not shown) overlying the roof decking portions 155, means for resisting flow of fluids 110 overlying at least a portion of the roof edge plates 152 and a portion of the roof decking 155 underneath the roof covering, the means for resisting flow 110 comprising elongated sections 111 of thin material having a T-shaped cross section and at least one fabricated corner assembly 20, 50 formed from at least one of the elongated sections 111. It is apparent to those skilled in the art that building of the roof construction 150 proceeds in the normal manner except that prior to applying roof drip edge 10, roof construction 150 has the novel hip corner assembly 50 adapted to mate with a hip corner 159 of roof construction 150 and be affixed to end 157 of hip juncture 154 and may further have the novel valley corner assembly 20 adapted to mate with a valley corner 158 of roof construction 150 affixed to the end 156 of valley juncture 153 respectively. Thereafter, straight sections 111 of drip edge 10 are applied over the free ends 35, 45, 65 and 75 of the corner assemblies 20, 50 with ends 15 of straight sections 111 of drip edge 10 overlapping the ends of corner assemblies 20, 50. It is common practice to overlap the ends 15 of straight sections 111 by approximately two inches although a greater or lesser amount may be utilized as well. The completed roof construction 150 of the instant invention provides for a substantially water tight outer roof edge 160 along roof edge plate 152 and especially at ends 156, 157 of junctures 153, 154.

Figure 2:
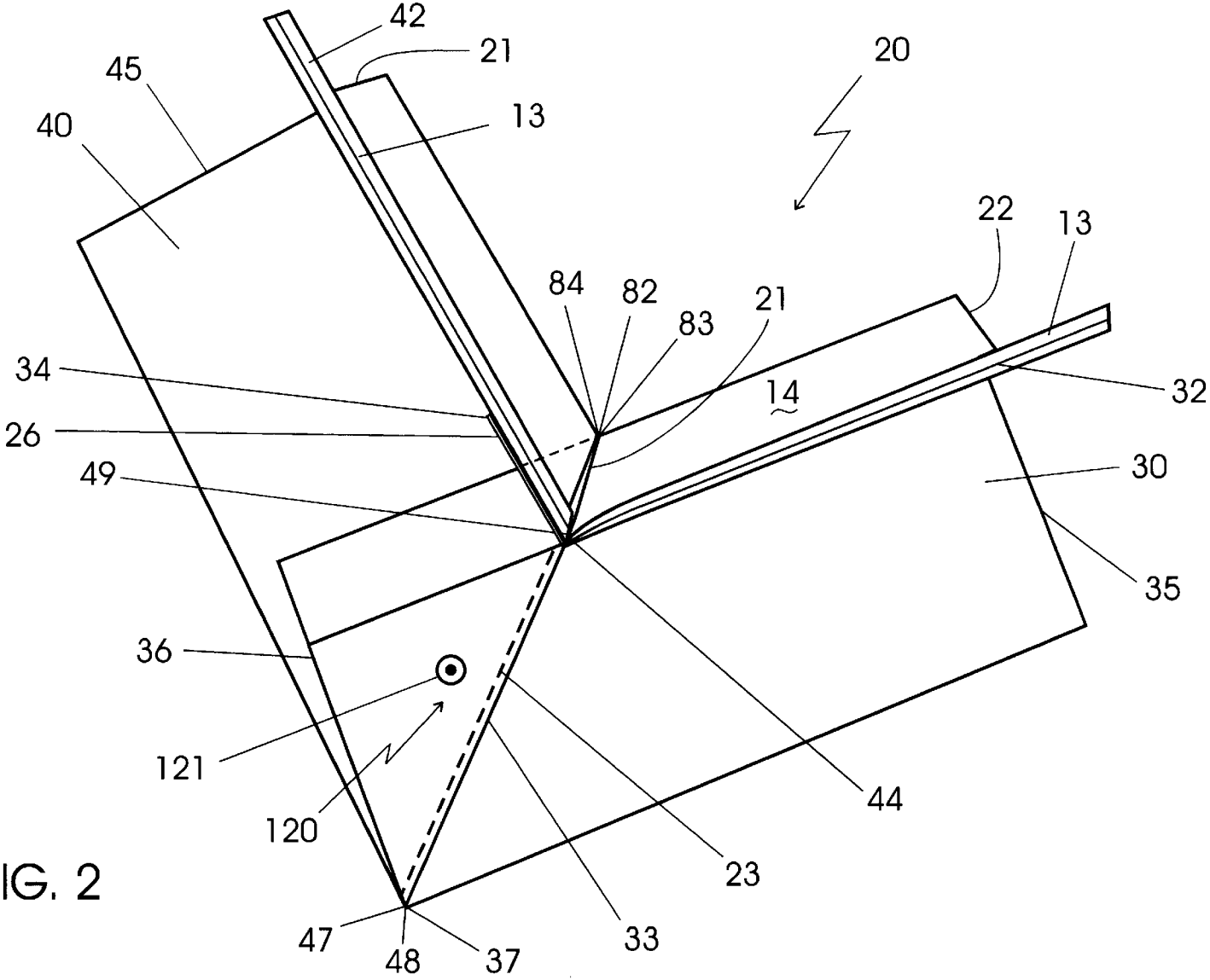
FIG. 2 is an inverted partially perspective view of the preferred embodiment of valley corner assembly showing the straight cut portion underling the miter cut portion.
Figure 7:
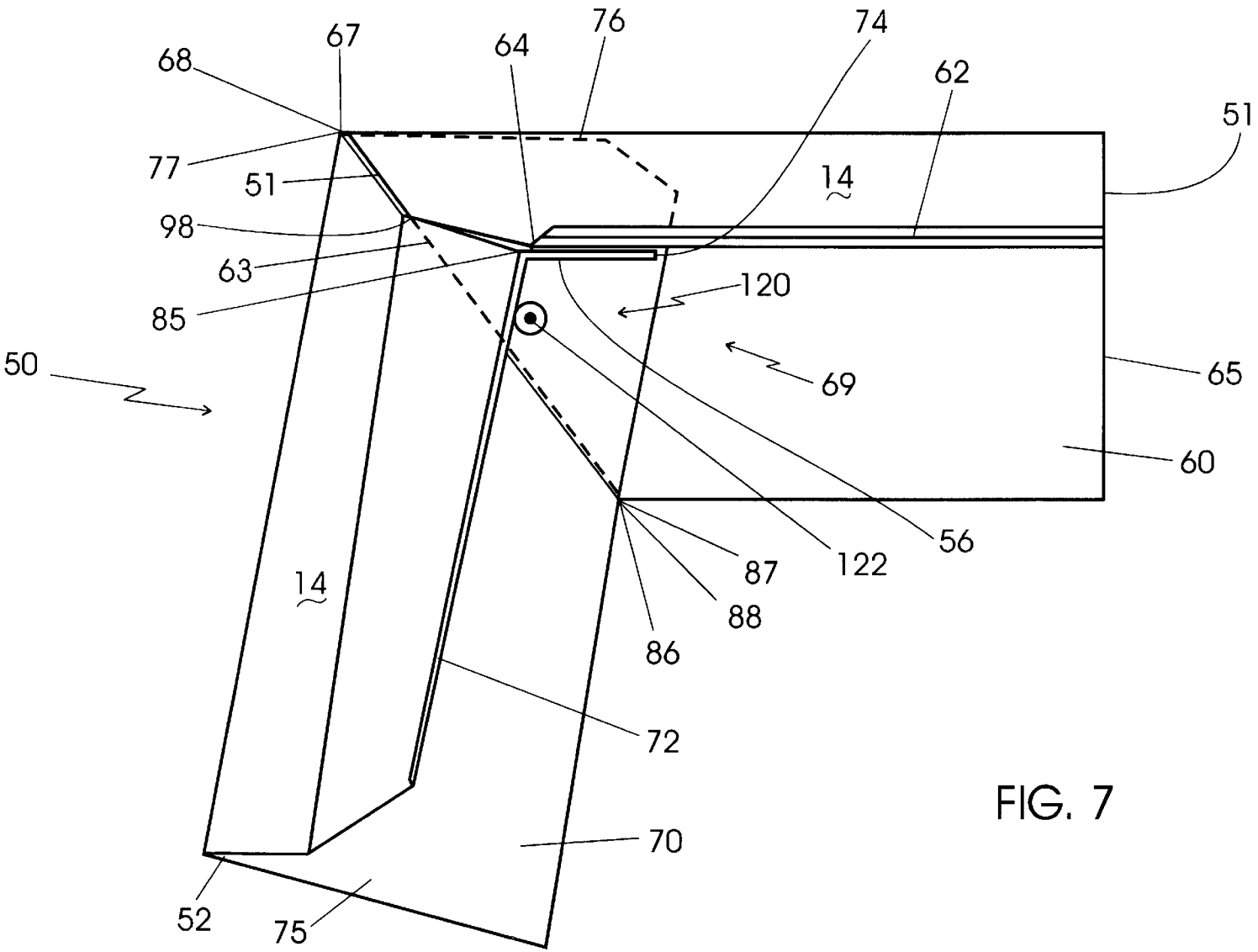
FIG. 7 is an inverted partially perspective view of the preferred embodiment of hip corner assembly showing the straight cut portion underling the miter cut portion.

Referring now to FIGS. 2 and 7, each fabricated corner assembly 20, 50 comprises at least one elongated miter cut portion 40, 60 miter cut from an elongated section 111 of thin material on at least one end 23, 53 thereof thereby forming at least one angled cut 43, 63 and at least one elongated bent tab portion 30, 70 straight cut from an elongated section 111 of thin material on at least one end 35, 59, 75, 99 thereof, at least one original terminal end 35, 59, 75, 99 of each straight cut bent tab portion 30, 70 adapted to be bent to form a joint tab 36, 76 to underlie angled cut 43, 63 of miter cut portions 40, 60 respectively. Each fabricated corner assembly 20, 50 has means for retaining 120 joint tab 36, 76 of each straight cut bent tab portion 30, 70 underlying an angled joint end 46, 66 of miter cut portion 40, 60 to joint end 46, 66 thereof. It can be readily observed in FIGS. 2 and 7 that joint tab 36, 76 of straight cut bent tab portion 30, 70 extend into a folded edge 21, 51 of miter cut portion 40, 60, folded edge 21, 51 of miter cut portion 40, 60 of fabricated corner assembly 20, 50 comprising a shingle extension 14 between the drip flange 42 and 62 and the roof flange 11 thereof, folded edge 21, 51 mating with a folded edge 22, 52 of straight cut bent tab portion 30, 70 of said fabricated corner assembly 20, 50, folded edge 22, 52 of straight cut bent tab portion 30, 70 comprising a shingle extension 14 between the drip flange 32 and 72 respectively and the roof flange 11 thereof.

Figure 8:
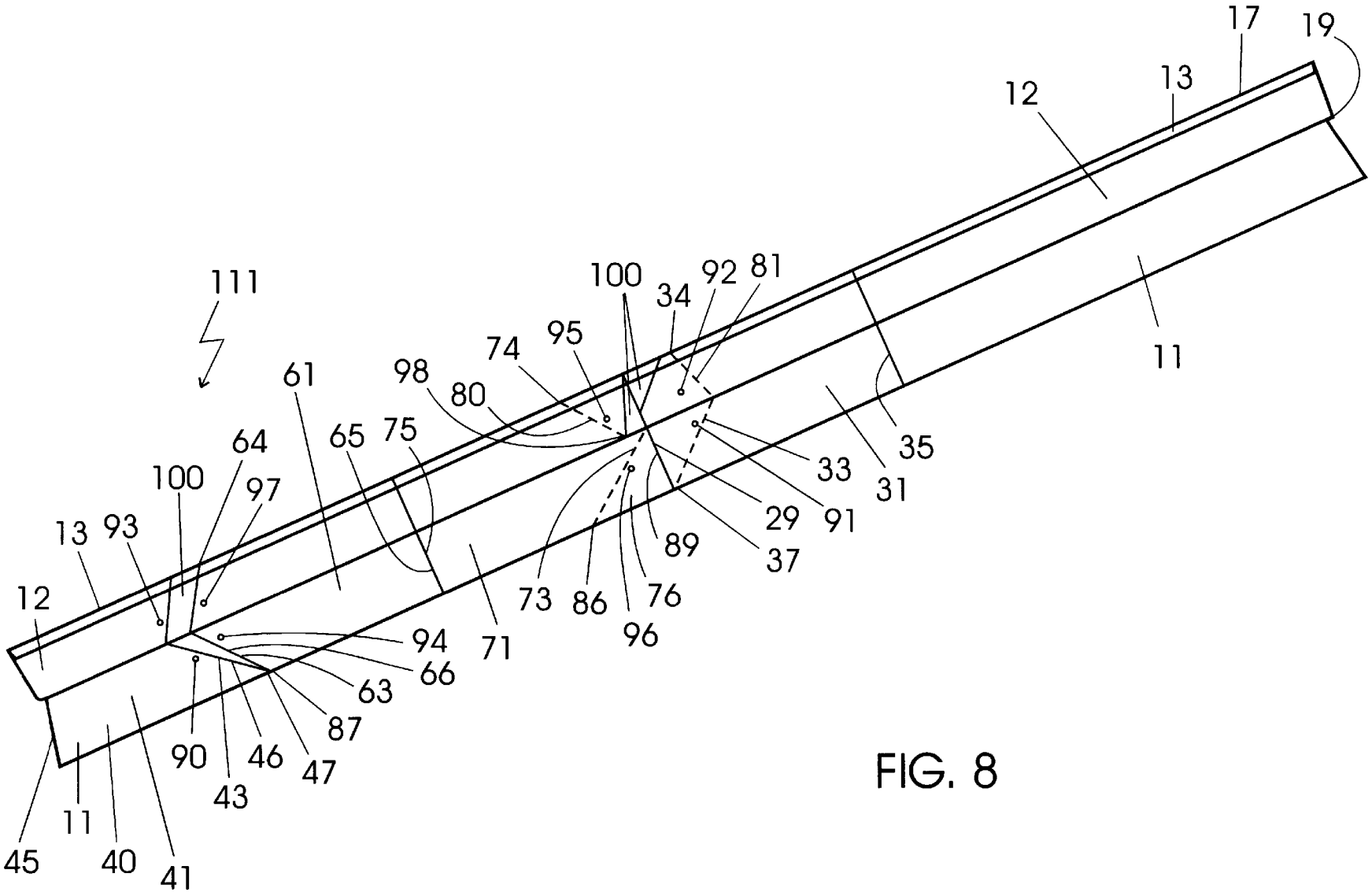
FIG. 8 is an inverted plan view of an elongated drip edge viewed at an angle of approximately 45° to the roof engaging surface and prior to cutting the miter cut portions of FIGS. 3 and 4 and the straight cut portions of FIGS. 5 and 6 therefrom showing the arrangement thereof to minimize waste.

Referring now to FIGS. 2, 3, 6 and 8, the novel valley corner assembly 20 of this invention is first shown in FIG. 8 as being cut from a straight section 111 of thin material or drip edge 10 into two separate pieces 30, 40. Bent tab portion 30 is cut at free end 35 parallel to an end of an elongated piece of drip edge 10 and at original terminal end 59 spaced therefrom while miter cut portion 40 is cut from an opposite end of an elongated piece of drip edge 10 at angled cut 43 spaced from free end 45, free end 45 comprising the opposite end thereof. Of course free end 45 may be cut simultaneously with free end 35, and in fact, since the portions 30, 40, 60 and 70 of multiple valley corner assemblies 20 and hip corner assemblies 50 may be cut from a single elongated piece of drip edge 10, it should be readily appreciated that free end 45 of miter cut portion 40 would be so established upon cutting of free end 35 of bent tab portion 30. The cutting of portions 30, 40, 60 and 70 will be described in full detail hereinafter.

Referring now specifically to FIG. 2 the novel valley corner assembly 20 is shown in inverted position with free ends 35 and 45 lying flat upon the plane of the paper and valley juncture point 48 elevated thereabove. Therefore, in order to best show the relationship of bent tab portion 30 affixed to miter cut portion 40, all remaining portions of valley corner assembly 20 are elevated above the plane of the paper upon which free ends 35, 45 lie. Bent tab portion 30 has two tabs 26, 36 formed from a drip flange 32 and a roof flange 11 respectively. Drip tab 26 is bent at approximately a ninety degree (90°) angle relative to drip flange 32 and is adapted to be fit around an up standing drip flange 42 of miter cut portion 40. Bent tab portion 30 has means for retaining 120 associated therewith to affix drip tab 26 to upstanding drip flange 42 thereto, for instance with a rivet (not shown) passed through holes 92, 93 (see FIG. 8) in drip tab 26 and drip flange 42. Thus, drip flange 32, 42 of valley corner assembly 20 for the roof construction 150 is adapted to be made continuous around end 156 of valley juncture 153. Similarly, joint tab 36 has been bent downwardly such that it lies under and contiguous with a portion of roof engaging surface 41 of miter cut portion 40. As can be readily observed in FIG. 2, fabricated valley corner assembly 20 comprises joint tab 36 of straight cut bent tab portion 30 extending into folded edge 21 of miter cut portion 40. It is fully appreciated here, that drip tab 26 is adapted to be contiguous with an outer surface 17 of drip flange 12 and thus underlies angled folded edge 13 and is not visible in FIG. 2 although joint tab 36 is fully visible in FIG. 2 as valley corner assembly 20 is shown in the aforementioned inverted position. The fabricated valley corner assembly 20 for a pitched roof construction 150 has means for retaining 120 joint tab 36 of each said straight cut bent tab portion 30 underlying the joint end 46 of the miter cut portion 40 to joint end 46 of miter cut portion 40. Means for retaining 120 may be accomplished by a rivet 121 passing through holes 91 and 90 of joint tab 36 and roof flange 11 respectively thereby affixing joint tab 36 to miter cut portion 40. Means for retaining 120 may be accomplished in other ways as will be hereinafter described. Thus, roof flange 11 of valley corner assembly 20 for roof construction 150 is made continuous across the decking 155 around end 156 of valley juncture 153.

Figure 3:
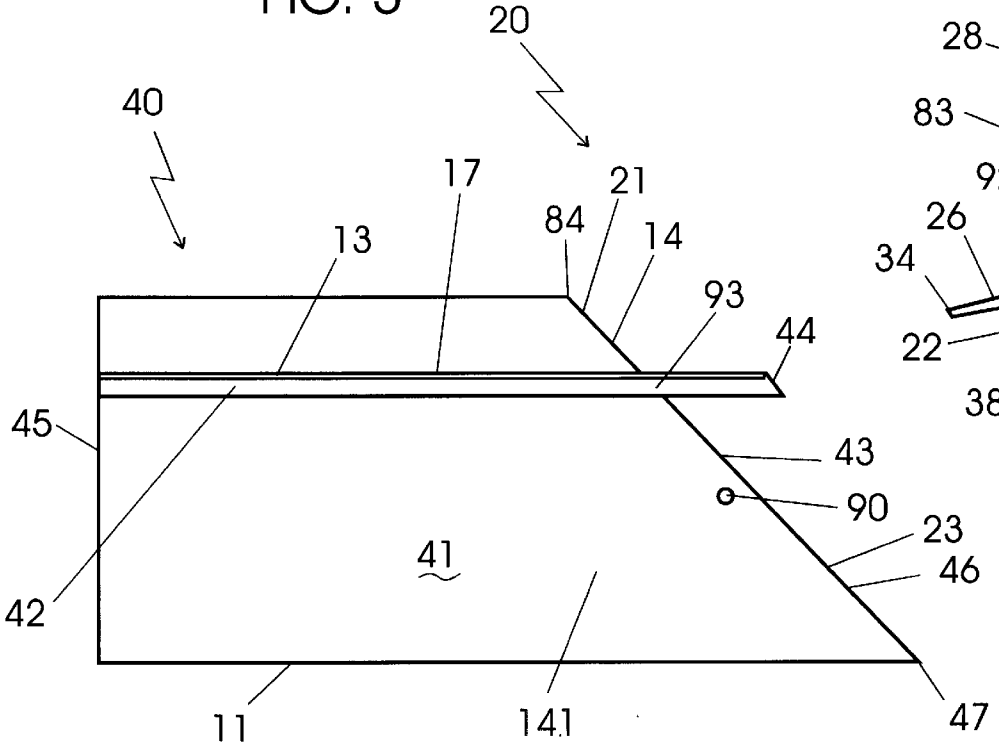
FIG. 3 is an inverted plan view of the miter cut portion of the valley corner of FIG. 2.

Miter cut portion 40 shown in FIG. 3, lies inverted upon the plane of the paper with exposed roof engaging surface 41 parallel to the plane of the paper and drip flange 42 perpendicular thereto. Similarly, bent tab portion 30 shown in FIG. 6 originally lies flat upon the plane of the paper as indicated by the solid outline extended by the dashed outline lines 39, however, since joint tab 36 is bent downwardly into the plane of the paper, bent tab portion 30 does not remain flat upon the plane of the paper but has its central portions elevated thereabove. In fact, once bent tab portion 30 is readied for use in assembling valley corner assembly 20, only free end 35, fold point 37 and terminal end point 18 contact the plane of the paper. Joint tab 36 is bent downwardly into the plane of the paper approximately thirty (30°) degrees.

Figure 6:
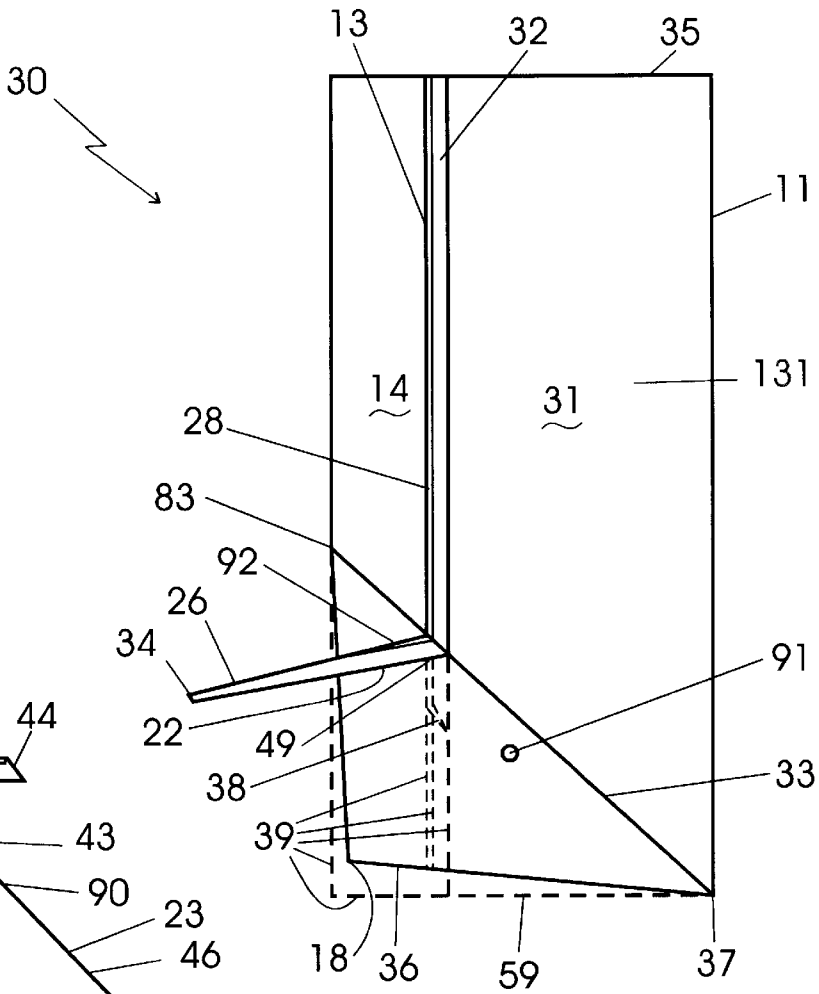
FIG. 6 is an inverted plan view of the straight cut portion of the valley corner of FIG. 2 showing both the initial cut configuration and the pre-assembly configuration.

Specifically referring to FIGS. 2, 3 and 6, valley corner assembly 20 is assembled by placing bent tab portion 30 and miter cut portion 40 in the proximate ninety degree (90°) angle relationship shown between FIGS. 3 and 6. Bent tab portion 30 is moved laterally toward miter cut portion 40 with joint tab 36 inserted into folded edge 21 in shingle extension 14 of miter cut portion 40, joint tab 36 extending over a portion of roof engaging surface 41 while drip tab 26 is placed adjacent upstanding drip flange 42 contiguous with outer surface 17. Bent tab portion 30 is then further moved laterally into miter cut portion 40 bringing juncture point 83 of bent tab portion 30 into contact with juncture point 84 of miter cut portion 40 forming shingle extension juncture 82 of valley corner assembly 20. Similarly, fold line 33 of bent tab portion 30 moves into registration with angled joint end 46 of miter cut portion 40 having sharp point 47 thereon joining with fold point 37 of bent tab portion 30 forming valley juncture point 48. Thereafter, bent tab portion 30 may be secured to miter cut portion 40 by providing means of retaining 120 such as by drilling a rivet hole 90, 91 through joint tab 36 and roof flange 11 and riveting these two portions together at this one point. However, there is nothing to prevent limited rotation of bent tab portion 30 around rivet 121 through holes 90, 91 and thereby away from miter cut portion 40 and therefore means of retaining 120 such as rivet holes 92, 93 are also provided through drip tab 26 and drip flange 42 with a rivet (not shown) passing through these two holes 92, 93 as well. Even though bent tab portion 30 and miter cut portion 40 are secured together with means for retaining 120, drip flanges 32, 42 may still flex relative to roof engaging surfaces 31, 41 respectively as shingle extension 14 is merely a portion of roof flange 11 folded back upon itself prior to forming of drip flange 12.

Still referring to FIGS. 3 and 6, those skilled in the art will appreciate that joint tab 36 of bent tab portion 30 may also be inserted into folded edge 21 at juncture point 84 by placing bent tab portion 30 above miter cut portion 40 and sliding joint tab 36 over roof engaging surface 41 until the portions 30, 40 come into registry along angled joint end 46 and fold line 33. Once bent tab portion 30 is in full registry with miter cut portion 40, flange end point 44 becomes contiguous with an upper edge 28 of drip flange 32 at interior corner 49 and flange end 34 of drip tab 26 lies substantially along the outer surface 17 of drip flange 42 adjacent angled folded edge 13 of drip flange 12.

Figure 5:
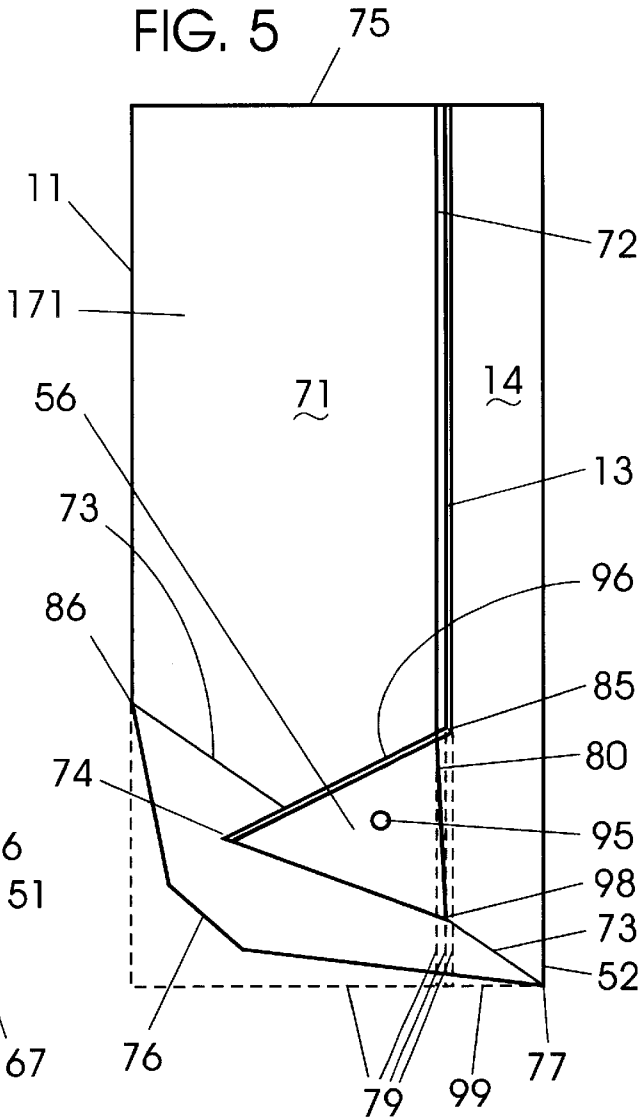
FIG. 5 is an inverted plan view of the straight cut portion of the hip corner of FIG. 7 showing both the initial cut configuration and the pre-assembly configuration.
Figure 4:
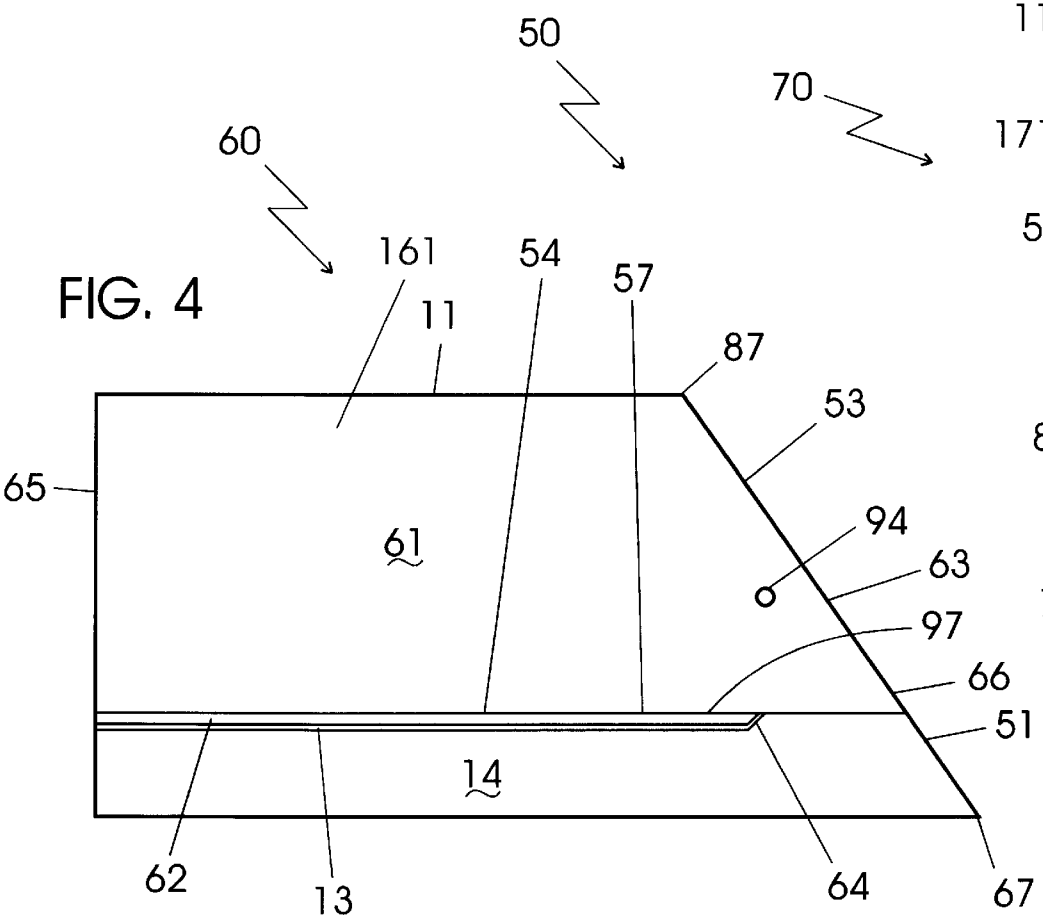
FIG. 4 is an inverted plan view of the miter cut portion of the hip corner of FIG. 7.

Referring now to FIGS. 4, 5, 7 and 8, the novel hip corner assembly 50 of this invention is first shown in FIG. 8 as being cut from a straight section 111 of drip edge 10 into two separate pieces 60, 70. Miter cut portion 60 and bent tab portion 70 are separated along straight cut free ends 65, 75 from a piece of drip edge 10 by cutting perpendicularly straight through drip flange 12, roof flange 11 and shingle extension 14 although either piece could be cut from either end of an elongated piece of drip edge 10. An angled cut 63 spaced from free end 65, is made through a drip flange 12 passing through roof flange 11 resulting in miter cut portion 60. Preferably, angled cut 63 is cut adjacent angled cut 43 of miter cut portion 40 thereby reducing the waste of cutting each piece separately from a piece of drip edge 10. In FIG. 4, miter cut portion 60 is shown lying upside down upon the plane of the paper with roof flange 11 lying on the plane and drip flange 62 extending perpendicularly upwardly therefrom. In FIG. 5, bent tab portion 70 also lies in an upside down position with roof flange 11 lying on the plane of the paper and drip flange 72 extending perpendicularly upwardly therefrom. Joint tab 76 is bent upwardly from the plane of the paper into the position shown by the solid lines in FIG. 5 while the dashed lines 79 show the position of joint tab 76 prior to bending upwardly and may have the outer point truncated as shown. Thus, after forming joint tab 76, the remainder of roof flange 11 of bent tab portion 70 remains flat upon the plane of the paper.

Referring now specifically to FIG. 7, the novel hip corner assembly 50 is shown in inverted position with roof flange 11 of miter cut portion 60 lying flat upon a flat plane and bent tab portion 70 elevated thereabove beginning at fold line 73. Therefore, in order to best show the relationship of bent tab portion 70 affixed to miter cut portion 60, all remaining portions of bent tab portion 70 are elevated above the plane of the paper upon which miter cut portion 60 lies. Bent tab portion 70 has two tabs 56, 76 formed from a drip flange 72 and a roof flange 11 respectively. Drip tab 56 is bent at approximately a ninety degree (90°) angle relative to drip flange 72 and is adapted to be fit around upstanding drip flange 62 of miter cut portion 60 and affixed thereto by means for retaining 120 such as with a rivet (not shown) passed through holes 95, 97 (see FIG. 8) in drip tab 56 and drip flange 62 respectively. Thus, drip flange 12 for hip corner assembly 50 for roof construction 150 is made continuous around end 157 of hip juncture 154. Similarly, joint tab 76 has been bent upwardly such that it lies under and contiguous with a portion of roof engaging surface 61 of miter cut portion 60. Joint tab 76 is also fixed to miter cut portion 60 by means for retaining 120 such as with a rivet 122 passing through holes 94 and 96 of joint tab 76 and miter cut portion 60 respectively. Thus, roof flange 11 for the roof construction 150 is made continuous across the decking 155 around end 157 of hip juncture 154.

Specifically referring to FIGS. 4, 6 and 7, the novel hip corner assembly 50 of this invention is assembled by inserting joint tab 76 of bent tab portion 70 into a folded edge 51 in shingle extension 14 of miter cut portion 60 and sliding joint tab 76 along roof engaging surface 61 until joint tab 76 becomes fully engaged therewith and drip tab 56 is in place adjacent to and contiguous with upstanding drip flange 42. The foregoing is accomplished while holding miter cut portion 60 directly below and in the inverted fashion shown in FIG. 4 at a ninety degree (90°) angle to bent tab portion 70 in the same relationship between the parts as shown in FIG. 4. When joint tab 76 is fully engaged in folded edge 51, roof flange juncture point 86 of bent tab portion 70 should be in contact with roof flange juncture point 87 of miter cut portion 60 forming hips juncture 88 of hip corner assembly 50. Similarly, fold line 73 of bent tab portion 70 moves into registration with angled joint end 66 of miter cut portion 60 having sharp point 67 thereon joining with fold point 77 of bent tab portion 70 forming shingle extension juncture point 68. Thereafter, bent tab portion 70 may be secured to miter cut portion 60 by means for retaining 120 such as by drilling a rivet hole 96 through joint tab 76 and hole 94 through roof flange 161 of miter cut portion 60 and affixing these two portions together at this one point. However, there is nothing to prevent some limited rotation of bent tab portion 70 around the rivet 122 just placed through holes 94, 96 and thereby away from miter cut portion 60 and therefore means for retaining 120 such as rivet holes 95, 97 are also provided through drip tab 56 and drip flange 62 respectively with a rivet (not shown) passing through these two holes 95, 97 as well. Even though bent tab portion 70 and miter cut portion 60 are secured together with means for retaining 120 at these two locations, drip flanges 62, 72 may still flex relative to roof engaging surfaces 61, 71 respectively as shingle extension 14 is merely a portion of roof flange 11 folded back upon itself prior to forming of drip flange 12.

Although the holes 90–97 have been described as drilled through the respective portions upon assembly of valley corner assembly 20 and hip corner assembly 50, holes 90–97 could be established through drip edge 10 at the time each piece 30, 40, 60, 70 is being cut therefrom as shown in FIG. 8 or alternately after cutting the various pieces therefrom.

Referring to FIGS. 4 and 5, those skilled in the art can appreciate that joint tab 76 of bent tab portion 70 may be inserted into folded edge 51 of miter cut portion 60 by moving these portions 60, 70 represented in the figures into proximity with each other such as by moving FIG. 5 to the left until it overlies FIG. 4 and thus joint tab 76 overlies roof surface 61 of miter cut portion 60 and thereafter moving bent tab portion 70 downwardly into folded edge 51 and into registry with miter cut portion 60 along angled joint end 66 and fold line 73. Once bent tab portion 70 is in full registry with miter cut portion 60, flange end point 64 becomes contiguous with an upper edge of joint bend 85 of drip flange 72 and sharp flange end 74 of drip tab 56 lies substantially along the inside bottom edge 54 of drip flange 62 adjacent folded edge 51.

Referring now to FIGS. 3 and 8, miter cut portion 40 is laid out at a square end, thus establishing free end 45, of an elongated piece of drip edge 10, drip edge 10 being in an inverted position with its roof flange 11 lying flat upon a plane and with its drip flange 12 extending perpendicular to the plane. Drip flange 12 has a folded edge 13 thereby doubling the thickness of drip flange 12 along folded edge 13 providing some rigidity to drip flange 12. In the preferred embodiment described herein, folded edge 13 is further bent slightly away from the plane of drip flange 12 and thus when installed upon a roof edge plate 152, folded edge 13 is bent away therefrom. Folded edge 13 has been omitted from FIG. 8 for clarity. Similarly, a doubled over folded edge may be also provided on roof flange 11, however, it has been omitted from all drawings to reduce the complexity thereof. If one end of an elongated piece of drip edge 10 is not square, a square cut should be made perpendicular to both drip flange 12 and roof flange 11 thereby establishing free end 45. Miter cut portion 40 is then severed from elongated drip edge 10 by making a double miter cut through drip flange 12 and roof flange 11 at one end 23 spaced a distance from free end 45. Typically, sharp point 47 of miter cut portion 40 should be spaced approximately eight inches from free end 45 though miter cut portions 40 may be longer or shorter as desired. The double miter angled cut 43 is made at substantially forty five degrees (45°) through roof flange 11 with respect to drip flange 12 and at an angle of substantially sixty (60°) degrees through drip flange 12 with respect to roof flange 11. The sixty (60°) degree cut through drip flange 12 is also made back toward free end 45 such that flange end point 44 overhangs angled joint end 46. Miter cut portion 40 is thus bound by sharp end point 47, flange end point 44, juncture point 84 and free end 45. Although free end 45 is shown and described as being square to the flanges 11, 12 of drip edge 10, some roof constructions 150 may dictate that an angled cut be made on both ends 23, 45 of miter cut portion 40 such that a valley corner assembly 20 and hip corner assembly 50 may be made arranged in close proximity.

Referring now to FIGS. 4 and 8, miter cut portion 60 is laid out opposing miter cut portion 40 of FIG. 3 on an elongated piece of drip edge 10, drip edge 10 being in an inverted position as described above. Miter cut portion 60 may be severed from elongated drip edge 10 by making a double miter cut at one end 53 through drip flange 12 and roof flange 11 beginning at the coincident sharp point 47 of miter cut portion 40 and roof flange juncture point 87 of miter cut portion 60. The double miter angled cut 63 is made at substantially fifty five (55°) through roof flange 11 with respect to drip flange 12 and at an angle of substantially sixty five (65°) degrees through drip flange 12 with respect to roof flange 11. The sixty five (65°) degree cut through drip flange 12 is also made away from free end 65 and back toward the now open end of the elongated piece of drip edge 10 established with the cutting of end 23 of miter cut portion 40 such that flange end point 64 does not overhang angled joint end 66 but rather resides over roof engaging surface 61 spaced away from angled joint end 66. Spaced from angled cut 63 is a free end 65 which is generally cut square with elongated piece of drip edge 10, that is, perpendicular to drip flange 12 and roof flange 11. Typically, sharp point 67 of miter cut portion 60 should be spaced approximately eight inches from free end 65 though miter cut portion 60 may be longer or shorter as desired. Miter cut portion 60 is thus bound by sharp end point 67, flange end point 64, roof flange juncture point 87 and free end 65. As the angled cuts 43, 63 oppose each other, a eight inch long miter cut portion 40 and a eight inch long miter cut portion 60 may be cut from a piece of drip edge 10 approximately ten inches in length.

In FIG. 8, it is apparent that little waste is created by thus cutting miter cut portion 60 and miter cut portion 40 from the same elongated piece of drip edge 10 by arranging miter cut portion 60 to oppose miter cut portion 40. The waste portion is shown in FIG. 8 by reference numeral 100 and comprises a wedge shaped portion of shingle extension 14, drip flange 12 and roof flange 11 between miter cut portion 40 and miter cut portion 60. It is also apparent that the only waste created in cutting bent tab portion 70 and bent tab portion 30 from an elongated piece of drip edge 10 is a small wedge shaped waste portion 100 of drip flange 12 of bent tab portion 70 between bent tab portion 30 and bent tab portion 70 as will hereinafter be described.

Referring now to FIGS. 5 and 8, bent tab portion 70 is laid out adjacent miter cut portion 60 of FIG. 4 on an elongated piece of drip edge 10, drip edge 10 being in an inverted position as described above. Free end 75 of bent tab portion 70 is formed when free end 65 is cut to form miter cut portion 60 as the square cut end of free end 65 is identical to the square cut free end 75. Spaced from free end 75 is another square cut 89 forming both original terminal ends 59 and 99 of bent tab portion 30 and bent tab portion 70 respectively. Free end 75 is typically spaced from terminal end 99 approximately eight inches although a greater or lesser distance may be utilized and still fall within the scope of this invention. In FIG. 5, original terminal end 99 is shown as a dashed line spaced from free end 75 joining with other dashed lines 79 to show the original flat portion of roof flange 11 of bent tab portion 70. The dashed lines in FIG. 8 are used to show fold lines 33, 73, 80, 81 for creating the tab portions 26, 36, 56 and 76 of bent tab portions 30, 70 respectively. A small wedge shaped waste portion 100 is created by a sixty (60°) degree cut in drip flange 12, this waste portion 100 shown centrally located near the top of FIG. 8. This waste portion 100 extends downwardly from flange end sharp point 74 to a cut line terminus 98 which was created by cutting through drip flange 12 along the base thereof from terminal end 99 to terminus 98. The cut along the base of drip flange 12 establishes drip tab 56 and merely separates the wedge shaped waste portion 100 from drip edge 10 at roof engaging surface 71.

Referring now to FIGS. 6 and 8, bent tab portion 30 is laid out adjacent bent tab portion 70 of FIG. 5 on an elongated piece of drip edge 10, drip edge 10 being in an inverted position as described above. Terminal end 59 of bent tab portion 30 is formed when terminal end 59 is cut to form bent tab portion 70 as hereinbefore described. Free end 35 is another square cut spaced from original terminal end 59 of bent tab portion 30 and is typically spaced from terminal end 59 approximately eight inches although a greater or lesser distance may be utilized and still fall within the scope of this invention. In FIG. 6, original terminal end 59 is shown as a dashed line spaced from free end 35 joining with other dashed lines 39 to show the original position of roof flange 11 and drip flange 12 of bent tab portion 30. As noted above, the dashed lines in FIG. 8 are used to show fold lines 33, 73, 80, 81 for creating the tab portions 26, 36, 56 and 76 of bent tab portions 30, 70 respectively. Drip tab 26 is established by cutting through drip flange 12 along the base thereof from terminal end 59 to fold line 73 thus separating drip tab 26 from roof flange 11 such that drip tab 26 may be bent at a ninety degree (90°) angle along fold line 81. Drip tab 26 further has a waste portion 100 removed from drip flange 12 as shown in FIG. 8 adjacent the waste portion 100 removed from drip flange 12 during the cutting of bent tab portion 70 as hereinbefore described. The end of truncated portion 38 of folded edge 13 is shown in FIG. 6 as a dashed point intermediate dashed lines 39 depicting the original position of drip flange 12.

In the preferred embodiment, the fabricated corner assembly 20, 50 of this invention has means for retaining 120 comprising a rivet passed through mating holes provided in roof flange 141, 161 of miter cut portion 40, 60 and roof flange 131, 171 of straight cut portion 30, 70 and alternately or additionally with a rivet passed through mating holes provided in drip flange 42, 62 of miter cut portion 40, 60 and drip tab 26, 56 of straight cut portion 30, 70 as hereinbefore described. Means for retaining 120 may further comprise an adhesive disposed in the folded edge 21, 51 of the miter cut portion 40, 60 and on roof engaging surface 41, 61 thereof and therefore between joint tab 36, 76 of straight cut portion 30, 70 and roof engaging surface 41, 61 and alternately or additionally between drip flange 42, 62 of miter cut portion 40, 60 and drip tab 26, 56 of straight cut portion 30, 70 respectively. For instance, referring now to FIGS. 3 and 6, during the assembly of valley corner assembly 20, an adhesive may be provided in folded edge 21 and along a portion of roof engaging surface 41 adjacent angled joint end 46 such that when joint tab 36 is inserted into folded edge 21 and bent tab portion 30 is moved laterally over miter cut portion 40 bringing juncture point 83 of bent tab portion 30 into contact with juncture point 84 of miter cut portion 40, bent tab portion 30 is retained against miter cut portion 40. In addition or alternately, as fold line 33 of bent tab portion 30 moves into registration with angled joint end 46 of miter cut portion 40 having sharp point 47 thereon an adhesive may be provided along outer surface 17 of upstanding drip flange 42 joining drip tab 26 of bent tab portion 30 to drip flange 42.

In like manner, referring now to FIGS. 4 and 5, during the assembly of hip corner assembly 50, an adhesive may be provided in folded edge 51 and along a portion of roof engaging surface 61 adjacent angled joint end 66 such that when joint tab 76 is inserted into folded edge 51 and bent tab portion 70 is moved laterally over miter cut portion 60 bringing roof flange juncture point 86 of bent tab portion 30 into contact with roof flange juncture point 87 of miter cut portion 60, bent tab portion 70 is retained against miter cut portion 60. In addition or alternately, as fold line 73 of bent tab portion 70 moves into registration with angled joint end 66 of miter cut portion 60 having sharp point 67 thereon an adhesive may be provided along inside surface 57 of upstanding drip flange 62 joining drip tab 56 of bent tab portion 70 to drip flange 62.

Means for retaining 120 may optionally comprise welding the roof flange 141, 161 of miter cut portion 40, 60 to the roof flange 131, 171 of straight cut portion 30, 70 and may also optionally comprise welding the drip flange 42, 62 of miter cut portion 40, 60 to the drip flange 32, 72 of straight cut portion 30, 70. Assembly of the novel valley corner assembly 20 of this invention proceeds in the same manner as described above for riveting the two portions 30, 40 together, however, in place of drilling the aforementioned holes, miter cut portion 40 and bent tab portion 30 are held in their respective relationships after assembly and a weld is placed along angled joint end 46 from shingle extension juncture point 82 to valley juncture point 48 and optionally along original terminal end 59 of joint tab 36 onto roof engaging surface 41. Other welds may be placed as well as one skilled in the art of welding may choose. Welding of hip corner assembly 50 is similar but requires welding of drip flanges 62, 72 on the exposed surface from flange end point 64 along joint bend 85 to shingle extension juncture point 68. Hip corner assembly 50 may be welded along joint tab 76 from shingle extension juncture point 68 to hip juncture 88.

Although means for retaining 120 has heretofore been described as being completed prior to placement of the novel corner assembly 20, 50 of this invention on a roof construction 150, it is to be understood that means for retaining 120 may be accomplished at assembly of the miter cut portions 40, 60 and bent tab portions 30, 70 directly upon roof edge plate 152 and roof decking 155. For instance, while holding either miter cut portion 40 and bent tab portion 30 or miter cut portion 60 and bent tab portion 70 together as described above, means for retaining 120 may comprise nails driven through roof flange 141, 161 of miter cut portion 40, 60, roof flange 131, 171 of straight cut bent tab portion 30, 70 and directly into roof decking 155 at least near juncture points 48, 68 and ends 35, 45, 65 and 75 of the respective parts. Optionally or additionally, while holding the assembled miter cut portion 40, 60 and bent tab portion 30, 70 together respectively as described above, means for retaining 120 may comprise nails driven through drip flange 42, 62 of miter cut portion 40,60, drip flange 32, 72 of straight cut bent tab portion 30, 70 into roof edge plate 152.

Novel valley corner assembly 20 and novel hip corner assembly 50 of this invention are adapted to be used on roof constructions 150 of various pitch as the drip flanges 32, 42, 62 and 72 and roof engaging flanges 131, 141, 161 and 171 can be flexed relative to each other when installing the novel corners 20, 50 thereon. For example, a roof construction 150 having a 4 pitch has an angle between roof edge plate 152 and roof decking 155 of approximately 18.4 degrees while a roof construction 150 having a 12 pitch has an angle of approximately 45 degrees between these respective surfaces. As a novel valley corner assembly 20 of this invention is placed in position upon end 156 of valley juncture 153 having interior corner 49 thrust thereinto in contiguous contact therewith, a fastener may be driven through roof flange 11 near valley juncture point 48 thereby fastening the central portion of valley corner assembly 20 to roof construction 150. Thereafter, free ends 35, 45 may be moved along the surface of decking 155 until drip flanges 32, 42 come into contact with roof edge plate 152. A fastener is then driven into decking 155 through roof flange 11 near free ends 35, 45. Since the ends 35, 45 of valley corner assembly 20 are flexible and each valley corner 20 is thrust into engagement with end 156 of valley juncture 153 and affixed thereto, the installation of valley corner assembly 20 is the same on each roof construction 150 without regard to the pitch of the roof.

In a similar manner, a novel hip corner assembly 50 of this invention is placed in position upon end 157 of hip juncture 154 having interior corner 69 thrust thereinto in contiguous contact therewith, a fastener may be driven through roof flange 11 near hip juncture point 88 thereby fastening the central portion of hip corner assembly 50 to roof construction 150. Thereafter, free ends 65, 75 may be moved along the surface of decking 155 until drip flanges 62, 72 come into contact with roof edge plate 152. A fastener may then be driven into decking 155 through roof flange 11 near free ends 65, 75. Since the free ends 65,75 of hip corner assembly 50 are flexible and each hip corner assembly 50 is thrust into engagement with end 157 of hip juncture 154 and affixed thereto, the installation of valley corner assembly 20 is the same on each roof construction 150 without regard to the pitch of the roof.

A method of providing a pitched roof construction 150 for a building construction comprises affixing rafters (not shown) to the upper edge of upstanding walls of the building construction, joining the rafters at at least one hip juncture 154 of roof construction 150, affixing a roof edge plate 152 to free ends of rafters overhanging the upstanding walls of the building construction, applying roof decking 155 over the rafters, roof decking 155 joining at at least one hip juncture 154, applying means for resisting flow 110 of fluids overlying at least a portion of roof edge plates 152 and a portion of roof decking 155 underneath a roof covering, means for resisting flow 110 comprising elongated straight sections 111 of thin material having a T-shaped cross section and wherein means for resisting flow 110 further comprises at least one fabricated corner assembly 20, 50 formed from at least one of the elongated straight sections 111. The method further comprises corner assembly 20, 50 adapted to have the free ends 35, 45, 65, 75 thereof overlapped with straight sections 111 of thin material wherein at least one fabricated corner assembly 50 is adapted to mate with a hip corner 159 of a building construction and is applied and affixed thereto and at least one fabricated corner assembly 20 is adapted to mate with a valley corner 158 of a building construction and is applied and affixed thereto.

In FIG. 1, there is also provided a drip edge construction 130 for a pitched roof construction 150, pitched roof construction 150 comprising roof decking 155, rafters supporting roof decking 155, roof edge plates 152 affixed to mitered ends of the rafters and adjacent the outer edge 160 of roof decking 155, drip edge 10 overlying at least a portion of roof edge plates 152 and a portion of roof decking 155 and being affixed thereto, a roof covering overlying roof decking 155 and drip edge construction 130 and wherein drip edge construction 130 has straight sections 111 and fabricated corner assemblies 20, 50, each fabricated corner assembly 20, 50 comprising at least one elongated portion of drip edge material 10 miter cut on at least one end 23, 53 thereof forming miter cut portions 40, 60 having angled joint ends 46, 66 and at least one elongated portion of drip edge material 10 straight cut on at least one end 59, 99 thereof, at least one end 59, 99 of each straight cut bent tab portion 30, 70 adapted to be bent forming bent tab portions 36, 76 to underlie at least one end 43, 63 of miter cut portion 40, 60 comprising angled joint end 46, 66 and be fixedly retained thereto.

Additionally, in FIGS. 1 through 8, in particular there is provided a pitched hip roof construction 150 of a building construction having at least four wall sections, the roof construction 150 comprising roof decking portions 155 joined at at least the exterior hip junctures 154 thereof, the outer edge 160 of roof construction 150 overhanging the walls of the building construction terminating in a roof edge plate 152 affixed to the ends of roof rafters adapted to support the decking portions 155 and the subsequent exterior roofing materials, the roof construction 150 further having a roof drip edge 10 applied over the terminal end of decking portions 155 and roof edge plate 152, and wherein the end 157 of each said hip juncture 154 has means for covering 140 affixed thereto prior to applying said exterior roofing materials. In the pitched hip roof construction 150 above, means for covering 140 comprises a fabricated hip corner drip edge assembly 50 and a fabricated valley corner drip edge assembly 20 cooperating with drip edge 10 to reduce the intrusion of fluid flowing over outer edge 160 into said roof construction 150.

Referring now to FIG. 8, in a method of making a fabricated hip corner assembly 50 and a fabricated valley corner assembly 20, an elongated straight section 111 of thin material is formed by folding an elongated flat strip of thin material at a folded edge 19 upon itself and thereafter forming an upright drip flange 12 perpendicular to a roof engaging flange 11, upright drip flange 12 being formed at a distance spaced from folded edge 19. An angled folded edge 13 may be formed upon the terminal edge of drip flange 12 by folding a short section of upright drip flange 12 upon itself mating the adjoining surfaces together. A similar folded edge may be formed at the terminal end of the roof flange 11, however this feature has been omitted from the drawings for clarity. Thus a drip edge 10 is formed from an elongated flat strip of thin material.

In the preferred method of forming miter cut portion 40, 60 and straight cut portion 30, 70, a thin strip of material of sufficient length is placed upon the working surface of a progressive die with roof engaging surface 31, 41, 61, 71 exposed wherein angled folded edge 13 overlies an angled edge of the working surface of a first die plate. Angled edge 13 is folded away from roof engaging surface 31, 41, 61, 71 when a second die plate clamps drip flange 32, 42, 62, 72 against the working surface of a first die plate. The second die plate additionally includes cutting edges to remove waste portion 100, sever miter cut portion 40 at angled cut 43, miter cut portion 60 at angled cut 63 and at free end 65 forming also free end 75 of straight cut portion 70, straight cut portion 70 at original free end 99 thereby also forming original free end 59 of straight cut portion 30 and finally at free end 35 thereof. In this preferred embodiment, holes 90–97 are pierced simultaneously with the cutting operations. The third stage of the die assembly comprises a series of upright plates disposed at a right angles to the working surface longitudinally thereof which are adapted to proceed downwardly into a series of slots disposed in the first die plate thereby forming folded edge 21, 22, 51, 52 by forcing a portion of the material into these slots while forming roof engaging flange 31, 41, 61, 71 alongside the series of upright plates. As waste 100 has been removed in the cutting process, miter cut portions 40, 60 may be removed from the die ready to assemble to straight cut portions 30, 70. However, straight cut portions 30, 70 further have joint tab 36, 76 and drip tab 26, 56 formed in a separate operation. For instance, bent tab portion 36 is formed in a narrow bight, such as the jaws of a vise by placing original terminal end 59 thereinto to fold line 33 and bending same downwardly approximately 30°. Drip tab 26 is then formed by inserting flange end 34 into the narrow bight to fold line 81 and bending same away from drip flange 32 approximately 90° extending beyond shingle extension 14. In like manner, joint tab 76 is formed by placing original terminal end 99 into the bight of the vise and bending same upwardly along fold line 73 approximately 30° and drip tab 56 is inserted into the bight of the vise to fold line 80 and bent 90° away from drip flange 72 over roof engaging flange 71. Although the aforementioned die assembly is described as forming all portions 30, 40, 60, 70 simultaneously, individual die assemblies may be constructed to form each portion separately from an elongated strip of flat material in a manner similar to the forming of all portions 30, 40, 60, 70 as herein described.

Drip edge 10 may also be formed in an automatic folding machine wherein an elongated strip of thin material is fed into the nip of feeding rollers, a second pair of rollers adapted to turn a portion of the thin strip back upon itself forming folded edge 19 and thereafter a third set of rollers adapted to form drip flange 12 from a major portion of the remainder previously turned upon itself by standing drip flange 12 perpendicular to axis of the elongated strip. Yet a fourth set of rollers may be utilized to form angled folded edge 13 by turning a minor portion of drip flange 12 upon itself, mating the adjoining surfaces and bending angled folded edge 13 at an angle away from the plane of drip flange 12. In the preferred embodiment, the thin strip of material is 12 gage aluminum sheeting approximately 5½" in width wherein roof flange 11 is approximately 2¾" wide, shingle extension 14 is approximately ¾" wide and drip flange 12 is approximately 2" wide. Angled folded edge 13 is less than ¼" in width and is angled from the plane of drip flange 12 at an angle of 45°. Although in this preferred embodiment aluminum sheeting is utilized, coated steel sheeting or thermoplastic sheeting of similar strength may be utilized. Thermoplastic sheeting would best be formed in an extrusion die of an extruder with the T-shaped cross section comprising the die opening.

After forming of drip edge 10 in a roller folder, the double miter cuts at angles 43, 63, straight cuts at ends 35, 45, 65, 75 and fold lines 33, 73, 80, 81 may be laid out upon the inside surface of drip flange 12 and roof flange 11 by any known means such as a carpenter's pencil or machinist's scribe utilizing the aforementioned layout description referring to FIG. 8. Thereafter, the cuts at angles and ends 35, 43, 45, 63, 65, 75 may be made by known means such as a common hacksaw or metal shears and bent tab portions 36 may be formed in a narrow bight, such as the jaws of a vise, by placing original terminal end 59 thereinto to fold line 33 and bending same downwardly approximately 30°. Drip tab 26 is then formed by inserting flange end 34 into the narrow bight to fold line 81 and bending same away from drip flange 32 approximately 90°. In like manner, joint tab 76 is formed by placing original terminal end 99 into the bight of the vise and bending same upwardly along fold line 73 approximately 30° and drip tab 56 is formed by inserting into the bight of the vise to fold line 80 and bending 90° away from drip flange 72.

Specifically referring to FIGS. 2, 3 and 6, valley corner assembly 20 is assembled by placing bent tab portion 30 and miter cut portion 40 in the proximate ninety degree (90°) angle relationship shown between FIGS. 3 and 6. Bent tab portion 30 is moved laterally toward miter cut portion 40 inserting joint tab 36 into folded edge 21 in shingle extension 14 of miter cut portion 40, joint tab 36 extending over a portion of roof engaging surface 41 while drip tab 26 is placed adjacent upstanding drip flange 42 contiguous with outer surface 17. Bent tab portion 30 is then further moved laterally into miter cut portion 40 bringing juncture point 83 of bent tab portion 30 into contact with juncture point 84 of miter cut portion 40 forming hip juncture 82 of valley corner assembly 20. Similarly, fold line 33 of bent tab portion 30 is moved into registration with angled joint end 46 of miter cut portion 40 having sharp point 47 thereon joining with fold point 37 of bent tab portion 30 forming valley juncture point 48. Thereafter, bent tab portion 30 may be secured to miter cut portion 40 by means of retaining 120 as hereinbefore described. However, where means for retaining 120 comprises rivets through pre-drilled holes, there is nothing to prevent limited rotation of bent tab portion 30 around rivet 121 through holes 90, 91 and thereby away from miter cut portion 40, therefore means of retaining 120 such as rivet holes 92, 93 are also provided through drip tab 26 and drip flange 42 with a rivet (not shown) passing through these two holes 92, 93 as well.

Where other means of retaining 120 are utilized, separate securing of the drip flange 12 and the roof flange 11 is largely accomplished in the securing of either flange to the corresponding flange. In all means of retaining 120, even though bent tab portion 30 and miter cut portion 40 are secured together with means for retaining 120, drip flanges 32, 42 may still flex relative to roof engaging surfaces 31, 41 respectively as shingle extension 14 is merely a portion of roof flange 11 folded back upon itself prior to forming of drip flange 12. Thus the various parts are preferably pre-manufactured and sold as multiple pre-packaged valley corner assemblies 20 or hip corner assemblies 50 nested together in shrink pack or cardboard cartons thus making selection easy for a construction worker.

In an alternate method utilizing a roller folder, prior to the folding of the elongated strip of thin material, scoring lines may be provided by perforating the thin material at angled cut 43, angled cut 63, free ends 35, 45, 65, 75, cut line 29, truncated portion 38 from sharp point 74 to terminus 98 and from original terminal end 59 through drip flange 12 to fold line 73 such that after folding the elongated strip of thin material into a drip edge 10, miter cut portions 40, 60 and straight cut bent tab portions 30, 70 may be broken from the elongated strip 111. Thereafter, bent tab portion 36 may be formed in a narrow bight, such as the jaws of a vise, by placing original terminal end 59 thereinto to fold line 33 and bending same downwardly approximately 30°. Drip tab 26 is then formed by inserting drip tab 26 into the narrow bight to fold line 81 and bending same away from drip flange 12 approximately 90°. In like manner, bent tab portion 70 is formed by placing original terminal end 99 into the bight of the vise and bending same upwardly along fold line 73 approximately 30° and drip tab 56 is inserted into the bight of the vise to fold line 80 and bent 90° away from drip flange 12. Fold lines 33, 73, 80 and 81 are marked on the flat strip of thin material prior to folding drip edge 10 into the T-shaped section and preferably are marked at the same time as the cut lines 29 and 89 and cuts at ends and angles 35, 43, 45, 63, 65, 75 are scored. It is readily apparent therefore, that by providing a pre-scored, folded T-shaped drip edge 10, the portions 30, 40, 60, 70 of novel corner assemblies 20, 50 of this invention may be broken therefrom, assembled at the job site and affixed to roof construction 150 in the manners recited above.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

We claim:

1. In a pitched roof construction comprising roof decking, rafters supporting said roof decking, roof edge plates affixed to mitered ends of said rafters adjacent the open edge of said roof decking, a roof covering overlying said roof decking, means for resisting flow of fluids overlying at least a portion of said roof edge plates and a portion of said roof decking underneath said roof covering, the improvement wherein said means for resisting flow comprises elongated sections of thin material having a T-shaped cross section and at least one fabricated corner assembly formed from at least one of said elongated sections wherein said fabricated corner assembly comprises at least one said elongated section of thin material miter cut on at least one end thereof and at least one said elongated section of thin material straight cut on at least one end thereof one end of each said straight cut section adapted to be bent to underlie said at least one end of said miter cut section, and wherein said fabricated corner assembly comprises one end of said straight cut section extending into a folded edge of said miter cut section.

2. A pitched roof construction as in claim 1 wherein said folded edge of said miter cut portion of said fabricated corner assembly comprises a shingle extension between the drip flange of said one said elongated section of thin material and the roof flange of said one said elongated section of thin material, said folded edge mating with a folded edge of said straight cut portion of said fabricated corner assembly, said folded edge of said straight cut portion comprising a shingle extension between the drip flange thereof and the roof flange thereof.

3. A pitched roof construction as in claim 2 wherein said means for retaining comprises adhesive in said folded edge of said miter cut portion and between said roof flange thereof and said roof flange of said straight cut portion.

4. A pitched roof construction as in claim 2 wherein said means for retaining comprises adhesive in said folded edge of said miter cut portion and between said drip flange thereof and said drip flange of said straight cut portion.

5. A pitched roof construction as in claim 2 wherein said means for retaining comprises a rivet passed through mating holes provided in said roof flange of said miter cut portion and said roof flange of said straight cut portion.

6. A pitched roof construction as in claim 2 wherein said means for retaining comprises a rivet passed through mating holes provided in said drip flange of said miter cut portion and said drip flange of said straight cut portion.

7. A pitched roof construction as in claim 2 wherein said means for retaining comprises a welding said roof flange of said miter cut portion to said roof flange of said straight cut portion.

8. A pitched roof construction as in claim 2 wherein said means for retaining comprises a welding said drip flange of said miter cut portion to said drip flange of said straight cut portion.

9. A pitched roof construction as in claim 2 wherein said means for retaining comprises nailing through said roof flange of said miter cut portion, said roof flange of said straight cut portion into said roof decking.

10. A pitched roof construction as in claim 2 wherein said means for retaining comprises nailing through said drip flange of said miter cut portion, said drip flange of said straight cut portion into said roof edge plate.

11. A pitched roof construction as in claim 1 wherein said fabricated corner assembly is adapted to mate with a hip corner of said building construction.

12. A pitched roof construction as in claim 1 wherein said fabricated corner assembly is adapted to mate with a valley corner of said building construction.

13. In a method of providing a pitched roof construction for a building construction, the method comprising affixing rafters to the upper edge of upstanding walls of the building construction, joining said rafters at at least one hip juncture of said roof construction, affixing a roof edge plate to free ends of said rafters overhanging the upstanding walls of the building construction, applying roof decking over said rafters, said roof decking joining at said at least one hip juncture, applying means for resisting flow of fluids overlying at least a portion of said roof edge plates and a portion of said roof decking underneath said roof covering, said means for resisting flow comprising elongated straight sections of thin material having a T-shaped cross section, the improvement wherein said means for resisting flow further comprises at least one fabricated corner assembly formed from at least one of said elongated sections wherein said fabricated corner assembly comprises at least one said elongated section of thin material miter cut on at least one end thereof and at least one said elongated section of thin material straight cut on at least one end thereof, one end of said straight cut section bent to underlie said at least one end of said miter cut section and wherein said fabricated corner assembly has one end of said straight cut section extending into a folded edge of said miter cut section.

14. A method of providing a pitched roof construction as in claim 13 wherein said corner assembly is adapted to have the free ends thereof overlapped with said straight sections of thin material.

15. A method of providing a pitched roof construction as in claim 13 wherein said fabricated corner assembly is adapted to mate with a hip corner of said building construction and is applied and affixed thereto.

16. A method of providing a pitched roof construction as in claim 13 wherein said fabricated corner assembly is adapted to mate with a valley corner of said building construction and is applied and affixed thereto.

17. In a drip edge for a pitched roof construction, said pitched roof comprising roof decking, rafters supporting said roof decking, roof edge plates affixed to mitered ends of said rafters and adjacent the open edge of said roof decking, said drip edge overlying at least a portion of said roof edge plates and a portion of said roof decking and being affixed thereto, a roof covering overlying said roof decking and said drip edge, the improvement wherein said drip edge comprises elongated straight sections of thin material having a T-shaped cross section and fabricated corner assemblies formed from at least one of said elongated sections, each said fabricated corner assembly comprising at least one elongated section miter cut on at least one end thereof and at least one elongated section straight cut on at least one end thereof, wherein said one end of said straight cut section is bent to underlie said at least one end of said miter cut section and extend into a folded edge of said miter cut section and be fixedly retained thereto.

18. A drip edge as in claim 17 wherein said folded edge of said miter cut section of said fabricated corner assembly comprises a shingle extension disposed between and integral with a drip flange of said one said elongated sections of thin material and the roof flange of said one said elongated sections of thin material, said folded edge mating with a folded edge of said straight cut section of said fabricated corner assembly, said folded edge of said straight cut section comprising a shingle extension disposed between and integral with a drip flange of said one said elongated section of thin material and a roof flange of said one said elongated section of thin material.

19. A drip edge as in claim 18 wherein said means for retaining comprises a rivet passed through mating holes provided in said roof flange of said miter cut section and said roof flange of said straight cut section.

20. A drip edge as in claim 18 wherein said means for retaining comprises a rivet passed through mating holes provided in said drip flange of said miter cut portion and said drip flange of said straight cut portion.

* * * * *